United States Patent [19]

Miyatake

[11] 4,188,842

[45] Feb. 19, 1980

[54] MANUAL VISE FOR ARTICLES OF VARYING SHAPES

[76] Inventor: Kanzi Miyatake, 7-4, 2-chome, Honancho-Nishi, Toyonaka-shi, Osaka Prefecture, Japan

[21] Appl. No.: 865,721

[22] Filed: Dec. 29, 1977

[30] Foreign Application Priority Data

May 14, 1977 [JP] Japan ..... 52/61540[U]
Sep. 1, 1977 [JP] Japan ..... 52/118047[U]

[51] Int. Cl.[2] ..... B25B 13/28
[52] U.S. Cl. ..... 81/103; 81/129
[58] Field of Search ..... 81/102, 103, 129, 130 R, 81/130 A, 134, 117

[56] References Cited

U.S. PATENT DOCUMENTS

| | | | |
|---|---|---|---|
| 966,300 | 8/1910 | Bennett | 81/103 |
| 1,386,433 | 8/1921 | Shaw | 81/129 X |
| 2,051,048 | 8/1936 | Kendall | 81/103 |
| 2,374,423 | 4/1945 | Davis | 81/103 |

*Primary Examiner*—James G. Smith
*Attorney, Agent, or Firm*—Wenderoth, Lind & Ponack

[57] ABSTRACT

A vise comprising a main bar; a guide holder pivotably mounted on the main bar and having a guide channel; a slide bar coextensive with the main bar and extending through the guide channel, and a holding pin secured to the guide holder and urged into engagement with the inner side face of the slide bar by a spring. A pair of jaws opposed to each other extend from the front ends of the bars respectively at right angles to the bars. When the guide holder is depressed against the action of the spring, the holding pin is disengaged from the inner side face of the slide bar, rendering the slide bar freely slidable forward or rearward.

4 Claims, 5 Drawing Figures

1
2
2a
2b
3
4
4b
5
6'
8
9
10
10a
10b
11
12
13
14
14a
15
17
18
19
c
d
i

MANUAL VISE FOR ARTICLES OF VARYING SHAPES

BACKGROUND OF THE INVENTION

The present invention relates to a manual tool for holding articles of varying shapes, and more particularly to a manual vise for articles of circular, rectangular or any other shape which will hold such an article quickly and positively and will turn the article or will hold an article against rotation. The vise further is adapted to release the article by a simple procedure.

In machining workpieces, as when drilling an article of especially of weight and size on a drilling machine, the workpiece is susceptible to being forced out of place by the great torque of the drill, so that unless firmly held in position, the workpiece cannot be accurately drilled, and there is the possibility of injuring the operator. Thus the drilling operation requires a tool for holding the workpiece. Pipe wrenches, monkey wrenches and the like are generally known as tools for holding workpieces. However, such wrenches are heavy, difficult to use and capable only of holding workpieces of sizes which are limited to a narrow range. Moreover the distance between the holding members of the wrenches is adjustable only slowly by turning the screw. In fact, it is impossible to set the holding members apart by any great distance at one time by a single action. Wrenches have another drawback. Since the holding members are movable toward or away from each other as positioned in parallel, they are unable to hold articles of irregular shape having no opposed sides.

SUMMARY OF THE INVENTION

An object of this invention is to provide a tool for use with articles of varying shapes for holding the article quickly and positively turning the article or for holding the article against rotation.

Another object of this invention is to provide a vise which is easy to use and quick to operate through a single procedure and with which, when the guide holder is depressed against the action of a spring, a slide bar is rendered freely movable so that the distance between a pair of opposed holding jaws can be greatly increased or decreased at one time.

Another object of this invention is to provide a tool in which a slide bar coextensive with the main bar is pivotally movable about a pin along with a guide holder, whereby a pair of holding jaws extending from the front ends of the bars can be positioned in an asymmetrical relationship.

Another object of this invention is to provide a vise of the type described which is simple in construction, is compact and lightweight, and which is adapted to accurately hold an article irrespective of its size or shape in such a manner so that as a handle at the rear end of the main bar is turned in the fastening direction with the article held between the opposed pair of holding jaws, the article is held with an increasing force.

BRIEF DESCRIPTION OF THE DRAWINGS

These and other objects of the invention will become more apparent in consideration of the following detailed description taken with the formal drawings, wherein.

DESCRIPTION OF THE PREFERRED EMBODIMENTS

Figure 1:
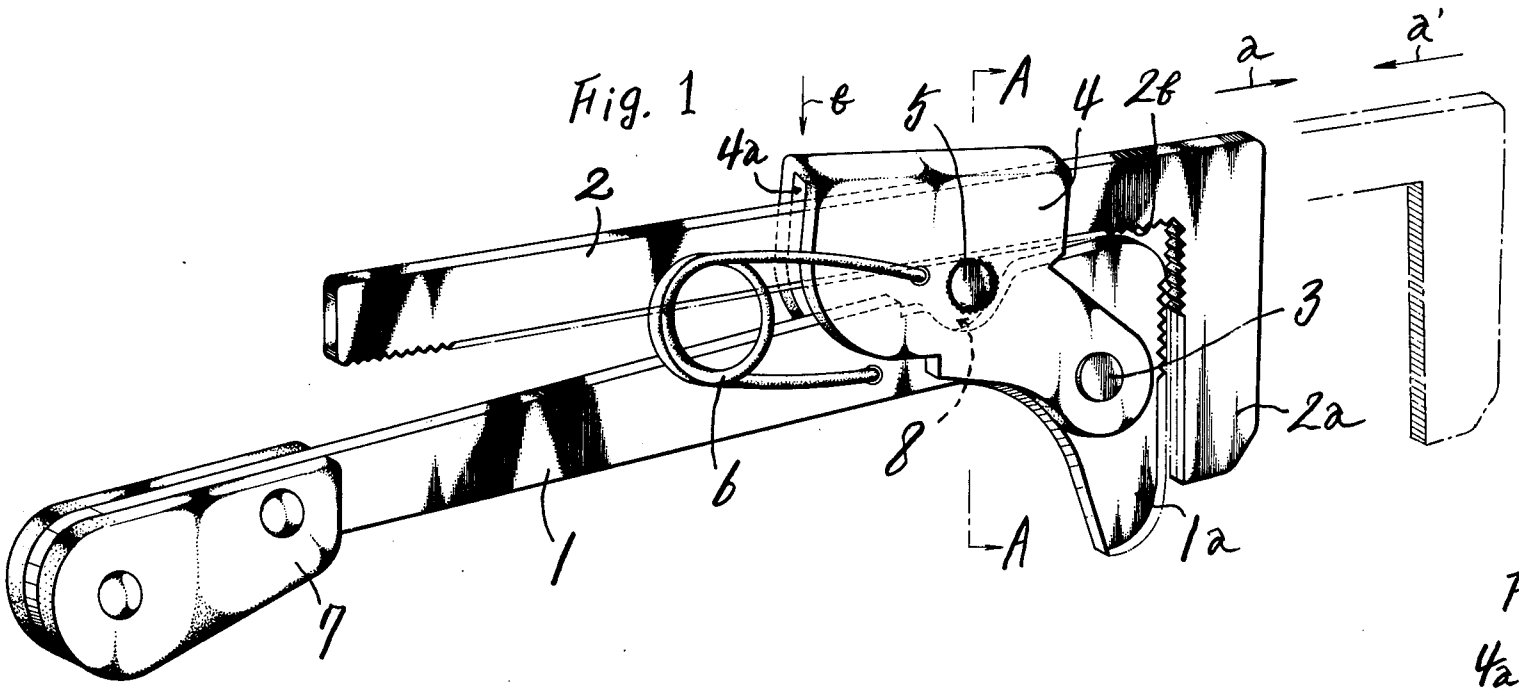
FIG. 1 is an overall perspective view showing a tool of this invention.
Figure 4:
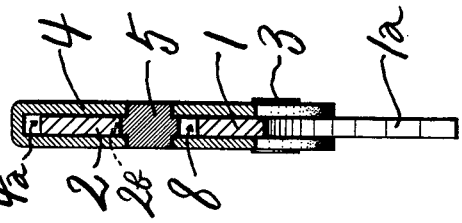
FIG. 4 is a view in section taken along the line A—A in FIG. 1.

With reference to FIG. 1, main bar 1 has a handle 7 at its rear end. A slide bar 2 is positioned above and coextensive with the main bar 1 and is slidable forward and rearward, i.e. in the direction of the arrows a and a'.

Jaws 1*a* and 2*a* extend downward from the front ends of the bars 1 and 2 at right angles thereto and are opposed to each other. An inverted U-shaped guide holder 4 of sheet steel is pivotally mounted by a pin 3 onto a front portion of the main bar 1 as if riding the main bar 1. The guide holder 4 has a guide channel 4*a* formed at its upper portion longitudinally of the main bar 1, with the slide bar 2 extending through the guide channel 4*a*. A holding pin 5 for the slide bar 2 positioned at least to the rear of and above the pivot pin 3 unturnably and fixedly extends through the guide holder 4 transversely thereof.

A spring 6 provided between the main bar 1 and the guide holder 4 biases the guide holder 4 upward about the pivot pin 3 at all times, thus urging the holding pin 5 into engagement with the inner side face of the slide bar 2. The main bar 1 is formed in its top side with a recessed portion 8 opposed to the holding pin 5. The holding pin 5 is movable into and out of the recessed portion 8.

Both the main bar 1 and the slide bar 2 are made from a flat steel plate of specified thickness. The inner side face of the slide bar 2 is provided with a holding toothed portion 2*b* for ensuring the engagement of the holding pin 5 with the slide bar 2.

Before the slide bar 2 on the main bar 1 is drawn out in the arrangement described above, the jaws 1*a* and 2*a* of the bars are positioned close to each other as seen in FIG. 1, and the holding pin 5 is in engagement with the toothed portion 2*b* on the inner side of the slide bar 2, with the spring 6 biasing the slide bar 2 upward. Accordingly, the slide bar 2 will not slide, even if someone attempts to pull out the bar 2 alone forward (in the direction of the arrow a).

Figure 2:
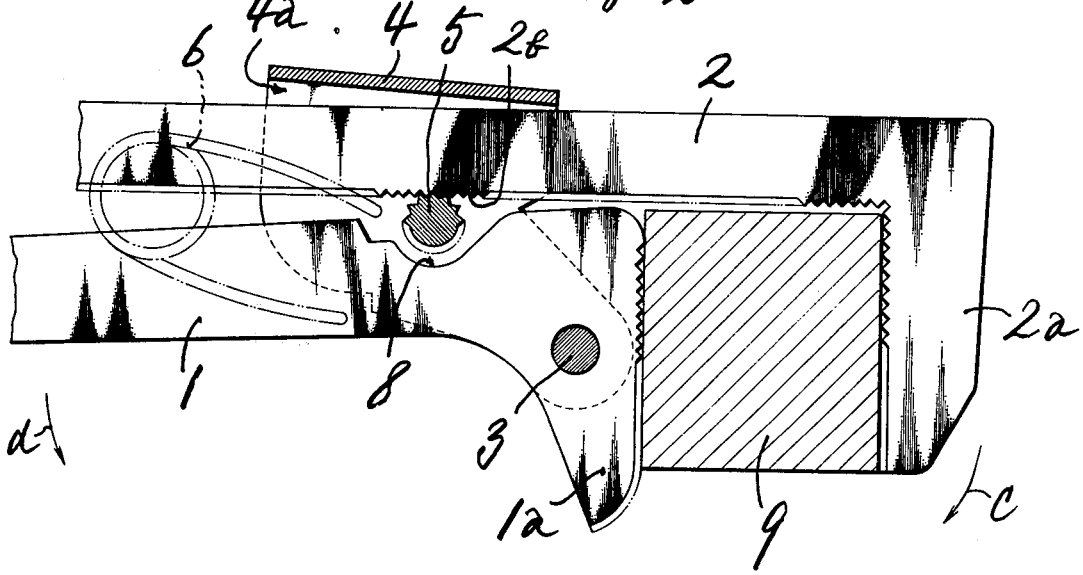
FIG. 2 is a side elevation in vertical section showing the main part of the tool while holding a square article.

When the guide holder 4 in this state is depressed on its rear upper portion in the direction of the arrow b, the guide holder 4 is turned downward about the pivot pin 3 against the action of the spring 6, thereby moving the holding pin 5 out of engagement with the toothed portion 2*b* on the inner side face of the slide bar 2. The slide bar 2, which is now free to move through the guide channel 4*a*, can be pulled out forward and, when withdrawn, the bar 2 is freely retractable to its original position. When holding an article 9, the slide bar 2 is pulled out forward by moving the jaw 2*a* away from the opposed jaw 1*a* the desired distance, and the article 9 is placed into the space between the jaws 1*a* and 2*a*. The guide holder 4 is thereafter relieved of the depressing force, whereupon the spring 6 acts to raise the guide holder 4 about the pivot pin 3, causing the holding pin 5 thereon to push up the slide bar 2. Consequently the jaw 2*a* at the front end of the slide bar 2 is forced toward the direction of the arrow c in FIG. 2 about the pivot pin 3, with the result that the article 9 is elastically held between the jaws 1*a* and 2*a* of the bars 1 and 2. If the gripped article 9 is given a clockwise torque in FIG. 2 with the main bar 1 held in position by the handle 7, the article 9 will be held between the jaws 1*a* and 2*a* under an increasing pressure. If the main bar 1 is turned in the direction of the arrow d from its rear end with the assumption that the article 9 is held in place, the article 9 will be forced inward between the jaws 1*a* and 2*a* with an increasing force as above while being turned counterclockwise in FIG. 2.

Figure 3:
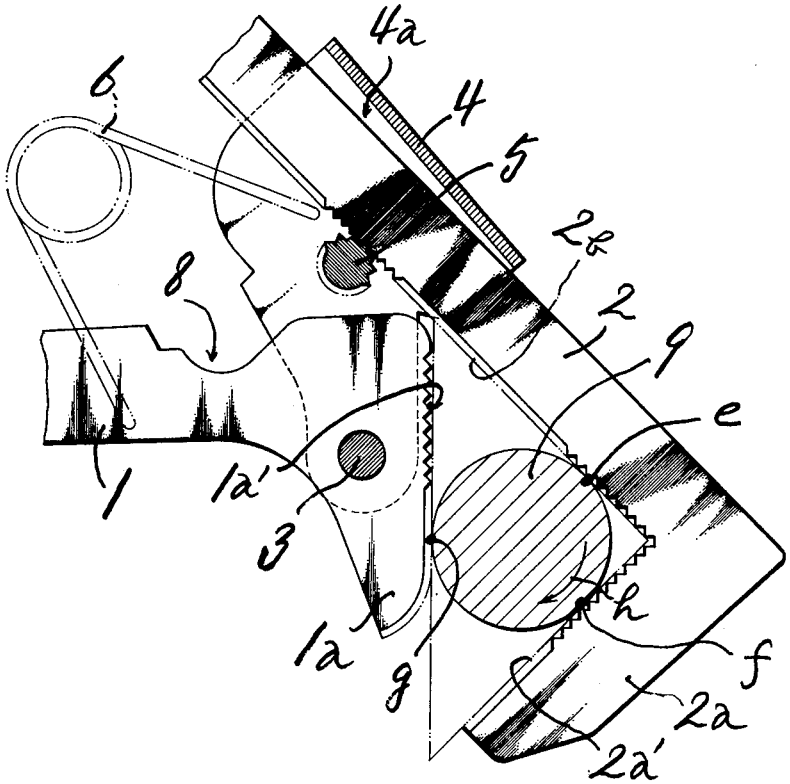
FIG. 3 is a side elevation in vertical section showing the main part of the tool while holding a circular or triangular article.

When where the article 9 is circular as seen in FIG. 3, the slide bar 2 is widely opened along with the guide holder 4 and the tool holds the circular article 9 by the three sides in contact therewith at three points e, f and g. Thus, the tool holds the circular article 9 at these three points with an increasing force against the turning of the article in a clockwise direction (indicated by the arrow h in FIG. 3). The article 9, when triangular, will be held by the three sides, namely the inner sides 1*a*′ and 2*a*′ of the jaws 1*a* and 2*a* and the front portion of the inner side of the slide bar 2.

The held article 9 is releasable by raising the handle 7 or by depressing the rear end upper portion of the guide holder 4 against the spring 6. This instantaneously relieves the article 9 of the holding force, and the slide bar 2 is rendered free to move. The jaw 2*a* is then moved away from the jaw 1*a* to release the article 9.

Figure 5:
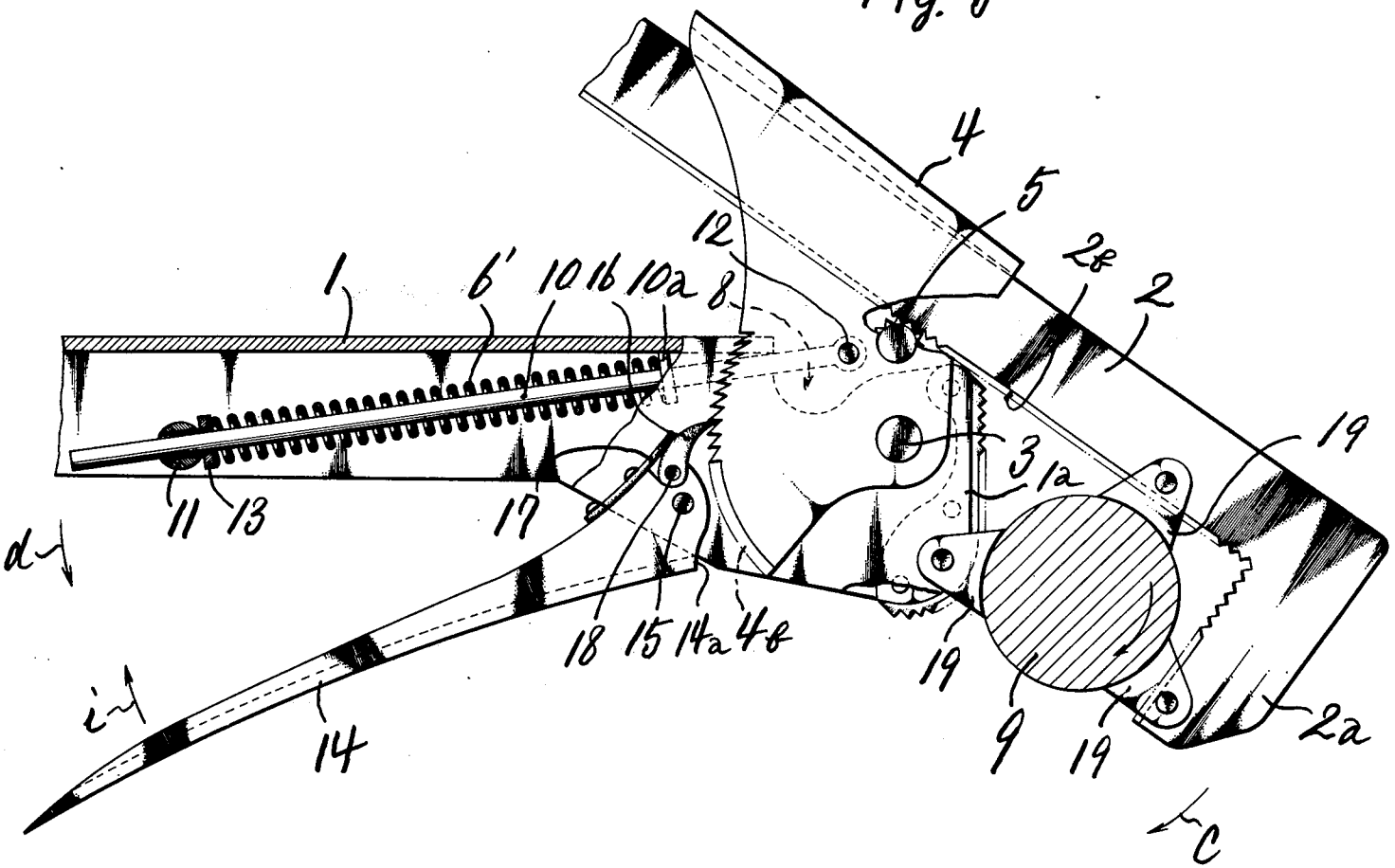
FIG. 5 is a side elevation showing the main part of another embodiment.

FIG. 5 shows another embodiment of this invention provided with locking means. The main bar 1 of this embodiment is made from channel steel. The hollow interior of the main bar 1 accommodates a coiled spring 6′ and a rod 10 for supporting the spring 6′. The spring 6′ on the rod 10 is held in a compressed state between a flange 10*a* secured to a front portion of the rod 10 and a support 11 loosely fitting in a rear portion of the main bar 1 transversely thereof. The spring 6′ pushes the rod 10 forward, biasing the guide holder 4 upward (clockwise in FIG. 5).

The rod 10 is pivotably supported at one end by a pin 12 positioned at least to the rear of and above the pivot pin 3 and extends transversely through the guide holder 4. The other end of the rod slidably extends through the support 11 and pivotally moves the guide holder 4 under the action of the spring 6′. A spring seat 13 is loosely mounted on the rod 10 and is in engagement with the support 11.

A locking lever 14 pivoted by a pin 15 to a lower portion of the main body 1 is provided with a locking pawl 16 pivotably mounted by a pin 18 on the front end of the lever. The locking pawl 16 is urged by a leaf spring 17 into engagement with the outer periphery of a rear lower portion of the guide holder 4. The rear lower periphery of the guide holder 4 is formed with teeth 4*b* with which the locking pawl 16 is engageable to lock the guide holder 4. The teeth 4*b* are formed along a circular arc centered about the pivot pin 3. When the locking lever 14 is moved toward the main bar 1, the locking pawl 16 raises the guide holder 4 in engagement with one of the teeth 4*b*, and also raises the holding pin 5 by a corresponding amount in pressing contact with the toothed portion 2*b* on the inner side of the slide bar 2. In addition the holding pin 5 is locked in its raised position.

FIG. 5 further shows auxiliary holding members 19 for snugly holding circular articles. The holding members 19 are pivotably attached to a front portion of the slide bar 2, the inner side of the jaw 2*a* thereof and the inner side of the jaw 1*a* of the main bar 1 at points where the circular article otherwise would directly contact these portions. The auxiliary holding members 19 are arranged at equal angular spacing. The holding members 19 are detachably attached to the vise when desired.

When the locking lever 14 is moved toward the main bar 1 in the direction of the arrow i with an article 9 held between the jaws, the locking pawl 16 moves in the same direction about the pin 15, raises the guide holder 4 in engagement with the tooth 4*b* and exerts an increasing holding force on the article. At the same time, the guide holder 4 is locked in its raised position.

To unlock the locking means and release the article 9, the locking lever 14 is pulled downward, thereby disengaging the locking pawl 16 from the tooth 4*b* for unlocking. The handle 7 is then raised or the guide holder 4 is depressed in its rear end upper portion against the spring 6, whereby the article 9 is free from the holding force, with the slide bar 2 rendered free to move. The jaw 2*a* is then moved away from the jaw 1*a*, whereon and the article is readily releasable.

As described above, the vise of this invention comprises a main bar; a guide holder pivotably mounted on the main bar and having a guide channel; a slide bar coextensive with the main bar and extending through the guide channel; and a holding pin secured to the guide holder and urged into engagement with the inner side face of the slide bar by a spring. The bars are formed with jaws respectively which are opposed to each other and extend from the front ends of the bars at right angles to the bars. Accordingly when the guide holder is depressed against the action of the spring, the holding pin is disengaged from the slide bar, thereby rendering the slide bar freely slidable, so that the distance between a pair of opposed jaws can be greatly increased or decreased easily and quickly. Additionally, the present vise is adapted to accurately hold an article irrespective of its size or shape in such a manner that, as the main bar is turned in the holding direction with the article held between the opposed jaws, the article is forced inward and can be held with an increasing force. The vise is inexpensive and compact, lightweight, simple and durable in overall construction. Thus the device of this invention has various outstanding advantages.

This invention is not limited to the embodiments described above. Other changes and modifications may be made without departing from the spirit and scope of this invention as defined in the appended claims.

What is claimed is:

1. A manual vise for holding articles of varying shapes, said vise comprising:

a main bar and a first jaw extending from said main bar at a right angle at one end thereof;

a slide bar above and coextensive with said main bar and a second jaw extending from one end of said slide bar at a right angle thereto opposite said first jaw;

a guide holder pivotally mounted on said main bar and having a guide channel therethrough, said slide bar extending through and being slidable within said channel;

a holding pin fixed transversely through said guide holder and engagable with said slide bar when said guide holder is pivoted, whereby the sliding movement of said slide bar in said channel is halted;

spring means connected between said main bar and said guide holder for urging said holding pin through said guide holder against said slide bar; and locking lever means pivotally connected to said main bar and engagable with said guide holder for locking said pivotable guide holder in a desired position.

2. A manual vise as claimed in claim 1, wherein:

said locking lever means is comprised of a lever arm pivotally connected to said main bar, and a locking pawl connected to one end of said lever arm; and said guide holder has a toothed portion on the outer edge thereof, said toothed portion being engagable by said locking pawl, whereby pivoting said lever arm causes said locking pawl to engage said toothed portion, thereby locking said guide holder against pivoting.

3. A manual vise as claimed in claim 1, wherein the side of said slide bar adjacent said main bar is formed with a toothed portion.

4. A manual vise as claimed in claim 3, wherein said holding pin has teeth around the circumference thereof, and said teeth are engagable with said toothed portion of said slide bar.

* * * * *